US007841712B2

(12) United States Patent
Muyskens et al.

(10) Patent No.: US 7,841,712 B2
(45) Date of Patent: Nov. 30, 2010

(54) AUTOMATIC PRINTHEAD AND TANK INSTALL POSITIONING

(75) Inventors: Robert Muyskens, Lexington, KY (US); Gregory S Woods, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 425 days.

(21) Appl. No.: 12/006,190

(22) Filed: Dec. 31, 2007

(65) Prior Publication Data

US 2009/0167819 A1 Jul. 2, 2009

(51) Int. Cl.
*B41J 2/18* (2006.01)

(52) U.S. Cl. ..... 347/91; 347/5; 347/49; 347/84; 347/85

(58) Field of Classification Search ..... 347/1–109
See application file for complete search history.

(56) References Cited

U.S. PATENT DOCUMENTS 6,003,985 A * 12/1999 Bekki ..... 347/86
6,802,602 B2 * 10/2004 Sakai et al. ..... 347/86
6,902,256 B2 * 6/2005 Anderson et al. ..... 347/56
6,938,976 B2 * 9/2005 Siwinski et al. ..... 347/19
7,128,408 B2 * 10/2006 Kosugi ..... 347/86

OTHER PUBLICATIONS http://files.support.epson.com/htmldocs/r800_/r800_rf/ink_1.htm dated 2001.*

* cited by examiner

*Primary Examiner*—Charlie Peng
*Assistant Examiner*—Guy G Anderson

(57) ABSTRACT

A system and method for automatically determining the appropriate printhead/ink tank installation position to move a carrier transporting the printhead/ink tanks for a printing device is presented. The carrier transporting the printhead/ink tank moves along a carrier frame and is covered by a protective cover. Once the protective cover is raised on the printing device, the status of the ink tank is sensed. Based on the ink tank status, the printing device carrier is moved to the appropriate printhead/ink tank installation position. In one embodiment, the status of the ink tank is determined by using the ink presence sensor. In another embodiment, the status of the ink tank is determined by using near field wireless communication with the memory of the ink tank.

14 Claims, 2 Drawing Sheets

AUTOMATIC PRINTHEAD AND TANK INSTALL POSITIONING

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to printing devices and printing methods, and more particularly to installing printheads and ink tanks on those printing device having or using semi-permanent printheads and on-carrier ink tanks.

2. Description of the Related Art

Typically, printing devices have either disposable printheads or semi-permanent printheads. In general, if the printing device has semi-permanent printheads, the printing device may also have on-carrier ink tanks. Printing devices with semi-permanent printheads and on-carrier ink tanks may have different install requirements than those printing devices with disposable printheads. For example, to install a disposable printhead, the printing device may only be required to move the printing device carrier transporting the printhead to the appropriate installation location along the carrier frame. In contrast, for a printing device with semi-permanent printhead and on-carrier ink tanks, the user may have to perform two or more functions to install the printhead and/or ink tanks. For example, users can either install ink tanks or install a printhead. This two step procedure can be even more complicated if the printhead/ink tank combination installation has additional requirements, such as, for example, having to remove all of the ink tanks before a printhead can be installed.

SUMMARY OF THE INVENTION

A system and method for automatically determining the appropriate printhead/ink tank installation position to move a carrier transporting the printhead/ink tanks for a printing device having a semi-permanent printhead is presented. The printing device carrier transports the printhead/ink tanks along a carrier frame inside the printing device and is covered by a protective cover. The carrier may have multiple different ink tank and printhead installation positions along the carrier frame. Once the protective cover is raised on the printing device, the status of the ink tank is sensed. Based on the ink tank status, the printing device carrier is moved to the appropriate printhead or ink tank installation position. In one embodiment, the status of the ink tank is determined by using the ink presence sensor, such as, for example, an optical sensor. In another embodiment, the status of the ink tank is determined by using near field wireless communication such as, for example radio frequency identification, with the memory of the ink tank.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1A:
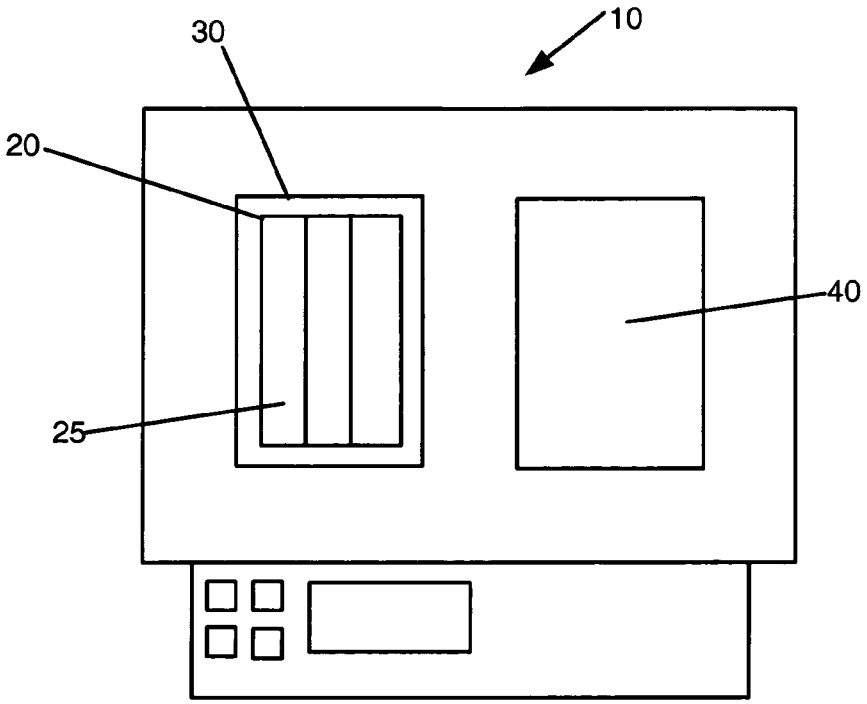
FIG. 1A is a schematic representation of a printing device illustrating one appropriate ink tank installation position according to an embodiment of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware.

The present invention provides a method for automatic printhead and ink tank installation positioning for a printing device. Such printing devices may utilize ink jet, dot matrix, dye sublimation, laser, and any other suitable print formats that utilize semi-permanent printheads and on-carrier ink tanks.

Referring to FIG. 1, a schematic representation of a printing device 10 with semi-permanent printheads 35 and on-carrier in tanks 25 is illustrated. Semi-permanent printheads 35 refer to printheads that last or are intended to last for a long time but not permanently. In one embodiment, the printing device 10 can comprise a carrier 20 which transports semi-permanent printheads 35 and on-carrier ink tanks 25 along a carrier frame that runs the width of the printing device 10. A protective cover (not shown) covers the carrier 20 and carrier frame area of the printing device 10. The printing device 10 also comprises a processor (not shown) that determines through various data input the appropriate installation position on the carrier frame for the printheads 35 and ink tanks 25 to which to move the carrier 20.

Figure 1B:
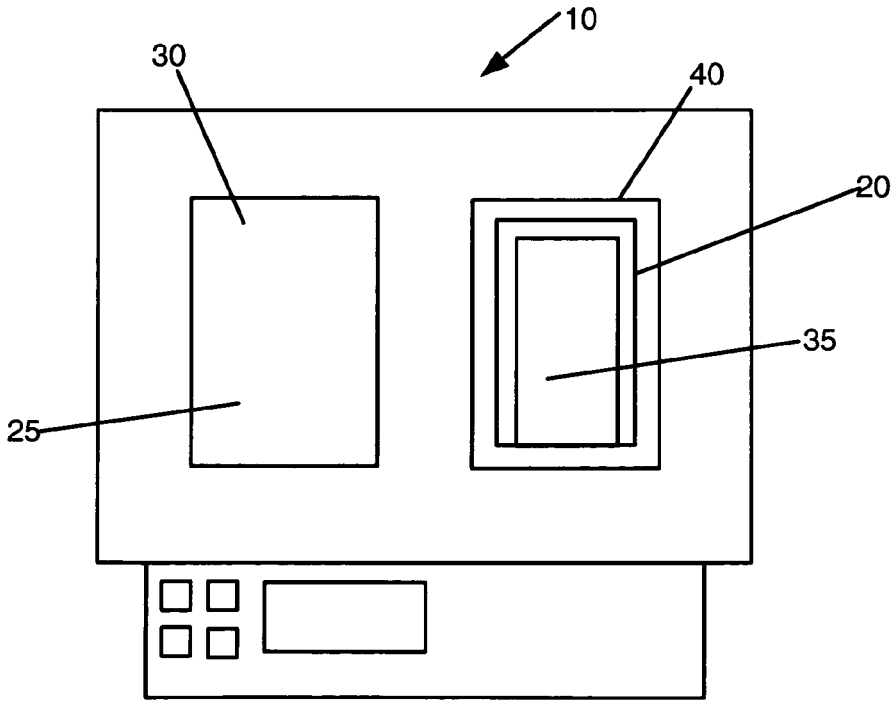
FIG. 1B is a schematic representation of a printing device illustrating one appropriate printhead installation position according to an embodiment of the present invention.

In order to prevent the user from trying to remove the printhead 35 before the ink tanks 25 are removed, the printing device 10 can have an installation position for the printheads 35 and another different installation position for ink tanks 25. For example, the first installation position can be the "ink tank install" position 30 for installing ink tanks as illustrated in FIG. 1A and the second position can be the a "printhead install" position 40 for installing the printheads as illustrated in FIG. 1B. However, the carrier 20 can have multiple different ink tank and printhead installation positions along the carrier frame. In one embodiment, when the carrier 20 is in the "ink tank install" position 30, the user can be physically locked out, or prevented, from unlatching the printhead 35. In other words, in this position, the user can only remove the ink tanks 25. This latching may help ensure that the user only removes the printhead 35 when the carrier is in the "printhead install" position 40. By have the printheads latched in the "ink tank install" position, the user may be prevented from making printhead/ink tank installation errors.

It is understood that latching of printhead 35, when carrier 20 is in an ink tank install position, may be implemented in any of a number of ways and that embodiments of the present invention are not limited to a particular printhead latching mechanism.

Figure 2:
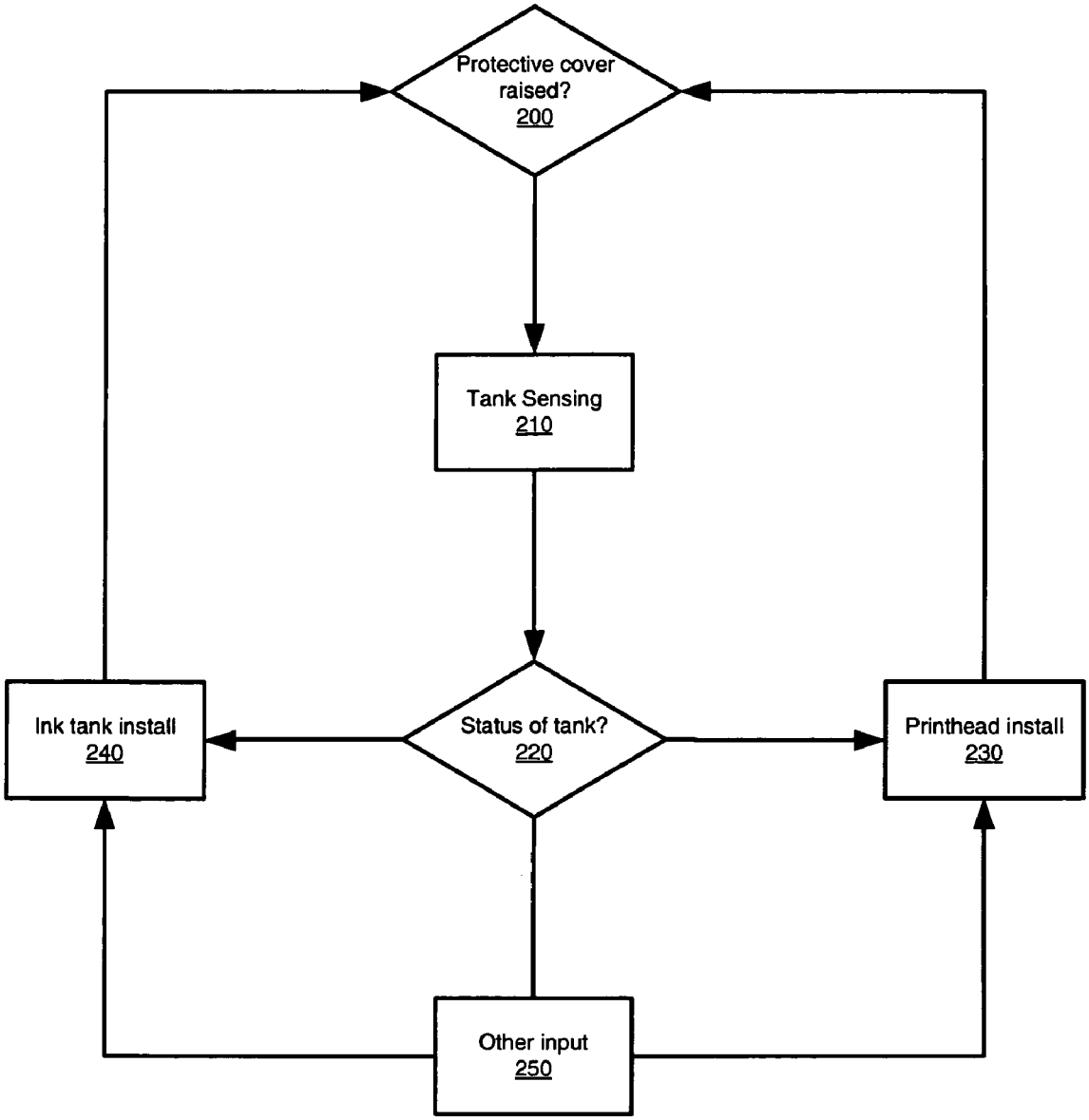
FIG. 2 is a flowchart of the method of automatic printhead and ink tank installation positioning for a printing device carrier according to an embodiment of the present invention.

Referring to FIG. 2, a flow chart illustrates a method for automatically determining the appropriate installation position to move the printing device carrier when the printing device's protective cover is raised, in order, to install a semi-permanent printhead and/or ink tanks. The method can be used to determine if an ink tank is installed in the printing device carrier. Beginning with step 200, it is determined whether the protective cover of the printing device is raised. If it is not, no action is taken. If the protective cover is raised, the status of the ink tank is sensed in step 210.

In one embodiment, the ink presence sensor data can be used to determine the status of the ink tank. An ink presence sensor may employ, for example, an optical sensor. The optical sensor can be focused, for example, on the bottom of the ink tank to determine whether the ink tank contains at least some predetermined amount of ink. If such amount of ink is detected, it can be determined that at least one ink tank may be located on the printing device carrier. In turn, this ink presence data can then be used by the installation positioning software resident on the printing device processor to process that at least one ink tank is present.

In another embodiment, wireless ink tank communication data can be used to determine the status of the ink tank. In this embodiment, the printing device can use near field wireless communication, such as, for example, radio frequency identification (RFID), with the ink tank memory. This wireless communication data can be used by the printing device processor to determine the presence of at least one ink tank by moving the carrier to the appropriate position in the carrier frame to sense the presence of any ink tanks in the carrier in its wireless field.

Printhead presence can be accomplished via the normal printhead sensing methods as is known in the art by the printing device processor. The ink tank presence information that was automatically determined by the ink tank sensor and the printhead presence information can then be used to determine the appropriate installation position to which to move the printing device carrier in step 220. If it is determined that neither ink tanks nor printheads are installed, the carrier can be moved to printhead installation position in step 230 since, in general, printheads need to be installed before the ink tanks installation. If, on the other hand, it is determined that both the printheads and ink tanks are installed, the carrier can be moved to ink tank installation position in step 240. In the ink tank installation position, the printheads can be latched to prevent their removal in this position. Finally, if no ink tanks are installed but the printheads are installed, other input methods known in the art can be used in step 250 to determine the appropriate installation position to which to move the carrier along the carrier frame.

The automatic determination of the type of ink tank/printhead installation positioning action that is most likely required by a printing device helps creates an ease of use benefit for the user.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for installing a printhead or an ink tank for a printing device, the method comprising:

raising a protective cover of the printing device;

sensing a status of the ink tank by ascertaining a presence or not of a predetermined amount of ink in the ink tank;

sensing a presence or not of the printhead on a carrier along a carrier frame; and automatically moving the carrier for transporting the printhead and the ink tank to one of two different appropriate installation positions along the carrier frame based on the sensed status of the ink tank and the sensed presence of the printhead, a first of the two different appropriate installation positions for installing the ink tank and the second of the two different appropriate installation positions for installing the printhead.

2. The method of claim 1 wherein the sensing is performed by wireless communication with memory of the ink tank.

3. The method of claim 2 wherein the wireless communication utilizes radio frequency identification.

4. The method of claim 2 wherein the sensing performed by wireless communication with memory of the ink tank, further comprising:

moving the carrier to an ink sensing position along the carrier frame to determine if at least one ink tank is present.

5. The method of claim 1, further comprising:

moving the carrier to the second of the two different appropriate installation positions if neither the ink tank nor the printhead is present.

6. The method of claim 1, further comprising:

moving the carrier to the first of the two different appropriate installation positions if both the ink tank and the printhead are present.

7. The method of claim 1, further comprising:

preventing unlatching of the printhead while the carrier is in the first of the two different appropriate installation positions.

8. The method of claim 1, wherein the carrier has multiple ink tank installation positions and multiple printhead installation positions along the carrier frame.

9. A printing device comprising:

a carrier for transporting at least one semi-permanent printhead and at least one ink tank, wherein the carrier moves along a carrier frame and during printhead and ink tank replacement or installation is configured to stop at either a first or second of two different positions along the carrier frame;

a first sensor for determining a status of the at least one ink tank;

a second sensor for determining a presence or not of the printhead; and a processor for determining an appropriate installation position from the two different positions for said replacement or installation of the at least one printhead or the at least one ink tank to move the carrier along the carrier frame based on the status of the at least one ink tank and the presence of the printhead.

10. The printing device of claim 9 wherein the first sensor is an ink presence sensor.

11. The printing device of claim 10 wherein the ink presence sensor is an optical sensor.

12. The printing device of claim 9 wherein the first sensor uses wireless communication with a memory of the at least one ink tank.

13. The printing device of claim 12 wherein the wireless communication uses radio frequency identification.

14. The printing device of claim 9, further comprising a latch mechanism for preventing removal of the printhead while the carrier is in the installation position for installing the at least one ink tank.

* * * * *